US008018214B2

(12) United States Patent
Kwon et al.

(10) Patent No.: US 8,018,214 B2
(45) Date of Patent: Sep. 13, 2011

(54) REGULATOR WITH SOFT-START USING CURRENT SOURCE

(75) Inventors: Yong Il Kwon, Gyunggi-do (KR); Joon Hyung Lim, Gyunggi-do (KR); Tah Joon Park, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 408 days.

(21) Appl. No.: 12/259,358

(22) Filed: Oct. 28, 2008

(65) Prior Publication Data

US 2009/0295340 A1 Dec. 3, 2009

(30) Foreign Application Priority Data

Jun. 3, 2008 (KR) ..... 10-2008-0052012

(51) Int. Cl.
*G05F 1/59* (2006.01)

(52) U.S. Cl. ..... 323/271; 323/901

(58) Field of Classification Search ..... 323/271, 323/282, 289, 901
See application file for complete search history.

(56) References Cited

U.S. PATENT DOCUMENTS

2007/0216383 A1 9/2007 Al-Shyoukh et al.
2008/0238397 A1* 10/2008 Chen et al. ..... 323/288
2009/0295340 A1* 12/2009 Kwon et al. ..... 323/220

* cited by examiner

*Primary Examiner* — Jeffrey L Sterrett
(74) *Attorney, Agent, or Firm* — Lowe, Hauptman, Ham & Berner, LLP

(57) ABSTRACT

There is provided a regulator with soft-start using a current source. The regulator with soft-start may include: a power switch unit including first and second power switches connected between a power supply terminal and an output terminal; a load capacitor connected between the output terminal and a ground; a voltage detection unit detecting a voltage of the output terminal; a comparison unit comparing a detection voltage and a predetermined reference voltage, and outputting first and second switching signals; a current generating a predetermined constant current; a current control unit switching a connection between a control terminal of the first power switch and the current source unit according to the first switching, and switching a connection between the control terminal of the first power switch and the ground according to the second switching signal; and an error amplification unit amplifying an error voltage between the detection.

8 Claims, 3 Drawing Sheets

REGULATOR WITH SOFT-START USING CURRENT SOURCE

CROSS-REFERENCE TO RELATED APPLICATIONS

This application claims the priority of Korean Patent Application No. 2008-0052012 filed on Jun. 3, 2008, in the Korean Intellectual Property Office, the disclosure of which is incorporated herein by reference.

BACKGROUND OF THE INVENTION

1. Field of the Invention

The present invention relates to regulators that are used in apparatuses requiring stable start-up, and more particularly, to a regulator with soft-start using a current source that can reduce noise and extend battery life by implementing soft-starting by using a current source to cause a predetermined amount of current to flow through a power switch at initial power up.

2. Description of the Related Art

In general, an external voltage of 3V is applied to IC devices. When an IC device has a core with a voltage of 1.8V, a voltage of 3V needs to be converted into a voltage of 1.8V by using a regulator. This regulator will be described with reference to FIGS. 2 and 3.

FIG. 1 is a conceptual view illustrating a regulator according to the related art.

A regulator, shown in FIG. 1, includes a power switch 10, a load capacitor CL, and a discharge switch SW. The power switch 10 is connected to a power supply Vcc to supply a current I. The load capacitor CL is charged with charges by the current I from the power switch 10, and outputs a predetermined voltage. The discharge switch SW is used to discharge the voltage charged in the load capacitor CL since an output voltage of the regulator needs to be a zero voltage in order to prevent a leakage current generated when the regulator is turned off.

The operation of the regulator according to the related art will be described with reference to FIGS. 1 and 2.

FIG. 2 is a view illustrating the operation of the regulator according to the related art. Referring to FIGS. 1 and 2, when the power switch 10 is turned on, a sudden surge of current is caused from the power supply Vcc to the load capacitor CL. Thus, a maximum current Imax flows at a predetermined time t1, and the largest amount of current is consumed. Here, the load capacitor CL is charged up to a predetermined voltage.

Then, when the regulator, shown in FIG. 1, is reset, the power switch 10 is turned off, and at the same time, the discharge switch SW is turned on to discharge the voltage charged in the load capacitor CL. Then, when the power switch 10 is turned on, and the discharge switch SW is turned off, as described above, a sudden increase of current is caused from the power supply Vcc to the load capacitor CL. The maximum current Imax flows at the predetermined time t1, and the largest amount of current is consumed. At this time, the load capacitor CL is charged up to the predetermined voltage.

However, in a case of the output voltage Vout that may be, for example, 1.8V, the load capacitor having a large capacitance value is used to remove ripple or noise as described above. When a voltage of 1.8V is output while the load capacitor is charged or discharged, a large amount of current is instantaneously consumed through the load capacitor at initial start-up.

SUMMARY OF THE INVENTION

An aspect of the present invention provides a regulator with soft-start using a current source that can reduce noise and extend battery life by implementing soft-starting by using a current source to cause a predetermined amount of time to flow through a power switch at initial power up.

According to an aspect of the present invention, there is provided a regulator including: a power switch unit including first and second power switches connected in series between a power supply terminal and an output terminal; a load capacitor connected between the output terminal and a ground, and charging a voltage by a current through the power switch unit; a voltage detection unit detecting a voltage of the output terminal; a comparison unit comparing a detection voltage of the voltage detection unit and a predetermined reference voltage, and outputting first and second switching signals having different phases according to a result of the comparison; a current source unit connected to the power terminal, and generating a predetermined constant current; a current control unit switching a connection between a control terminal of the first power switch and the current source unit according to the first switching signal of the comparison unit, and switching a connection between the control terminal of the first power switch and the ground according to the second switching signal of the comparison unit; and an error amplification unit amplifying an error voltage between the detection voltage of the voltage detection unit and the predetermined reference voltage.

The first power switch may include a first P channel MOS transistor having a drain connected to the power supply terminal, a source connected to the second power switch, and a gate connected to a first connection node between the first and second current control switches, and the second power switch includes a second P channel MOS transistor having a drain connected to the source of the first power switch, a source connected to the output terminal, and a gate connected to an output terminal of the error amplification unit.

The voltage detection unit may include a resistor circuit dividing the voltage of the output terminal, and detecting first and second detection voltages by the resistor circuit.

The comparison unit may compare a first detection voltage of the voltage detection unit and the predetermined reference voltage, and generate a first switching signal having a switching-on level and a second switching signal having a switching-off level when the first detection voltage has a lower level than the predetermined reference voltage, or generate a first switching signal having a switching-off level and a second switching signal having a switching-on level when the first detection voltage has a higher level than the reference voltage.

The current source unit may include: third and fourth P channel MOS transistors having drains connected to the power supply terminal and gates connected to each other; a first N channel MOS transistor having a drain connected to a source of the fourth P channel MOS transistor, and a gate connected to a source of the third P channel MOS transistor; a second N channel MOS transistor having a drain connected to the source of the third P channel MOS transistor, a gate connected to a source of the first N channel MOS transistor, and a source connected to the ground; and a variable resistor connected to the gate of the second N channel MOS transistor and the ground, and varying in resistance.

The variable resistor may vary the soft-start duration by controlling the constant current of the current source unit. The current control unit may include: a first current control switch connected between the control terminal of the first power switch and the current source unit, and turned on or off according to the first switching signal of the comparison unit; and a second current control switch connected between the control terminal of the first power switch and the ground, and turned on or off according to the second switching signal of the comparison unit.

The error amplification unit may include: a fifth P channel MOS transistor having a drain connected to the power supply terminal; a sixth P channel MOS transistor having a drain connected to the power supply terminal, and a gate and a source connected to a gate of the fifth P channel MOS transistor, a third N channel MOS transistor having a gate receiving the reference voltage, and a drain connected to a source of the fifth P channel MOS transistor; a fourth N channel MOS transistor having a gate receiving a second detection voltage of the voltage detection unit, a drain connected to the source of the sixth P channel MOS transistor, and a source connected to a source of the third N channel MOS transistor; and a current source connected between a second connection node between the sources of the third and fourth MOS transistors and the ground, wherein a third connection node between the source of the fifth P channel MOS transistor and the drain of the third N channel MOS transistor is connected to the gate of the second power switch.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
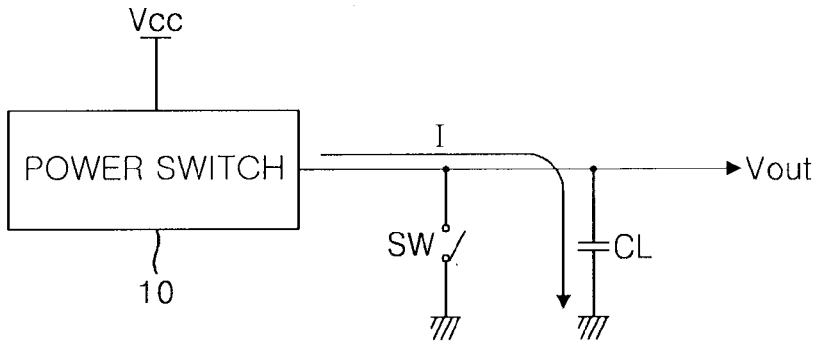
PRIOR ART FIG. 1
FIG. 1 is a conceptual view illustrating a regulator according to the related art.
Figure 2:
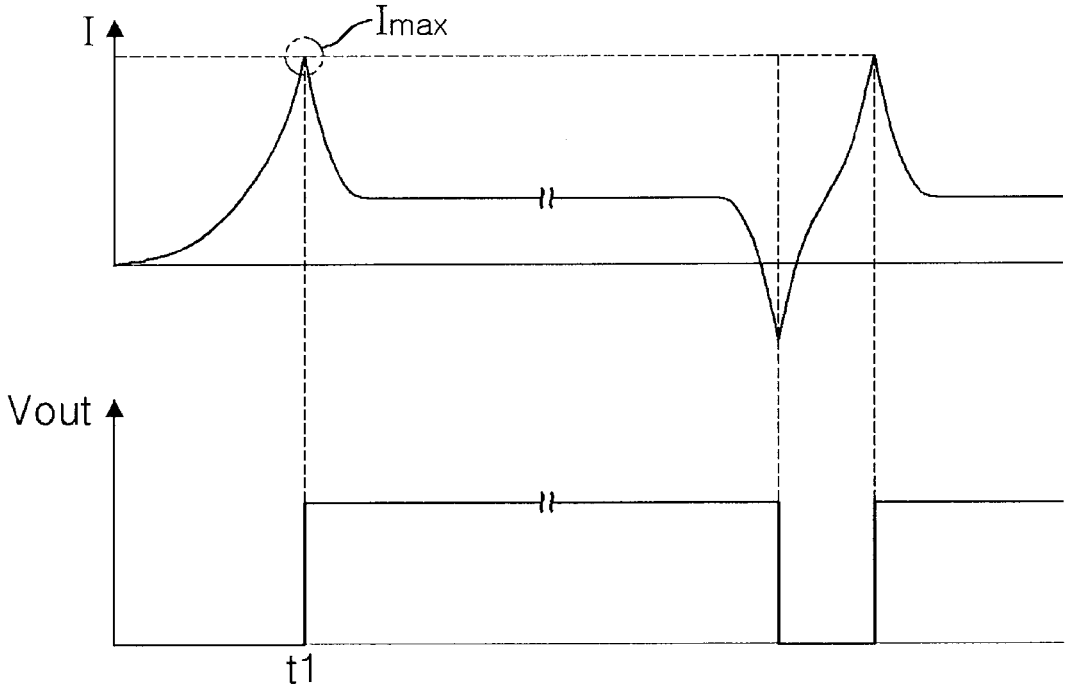
PRIOR ART FIG. 2
FIG. 2 is a view illustrating the operation of the regulator according to the related art.

Exemplary embodiments of the present invention will now be described in detail with reference to the accompanying drawings.

The invention may however be embodied in many different forms and should not be construed as limited to the embodiments set forth herein. Rather, these embodiments are provided so that this disclosure will be thorough and complete, and will fully convey the scope of the invention to those skilled in the art. Also, in the drawings, the same reference numerals are used throughout to designate the same components.

Figure 3:
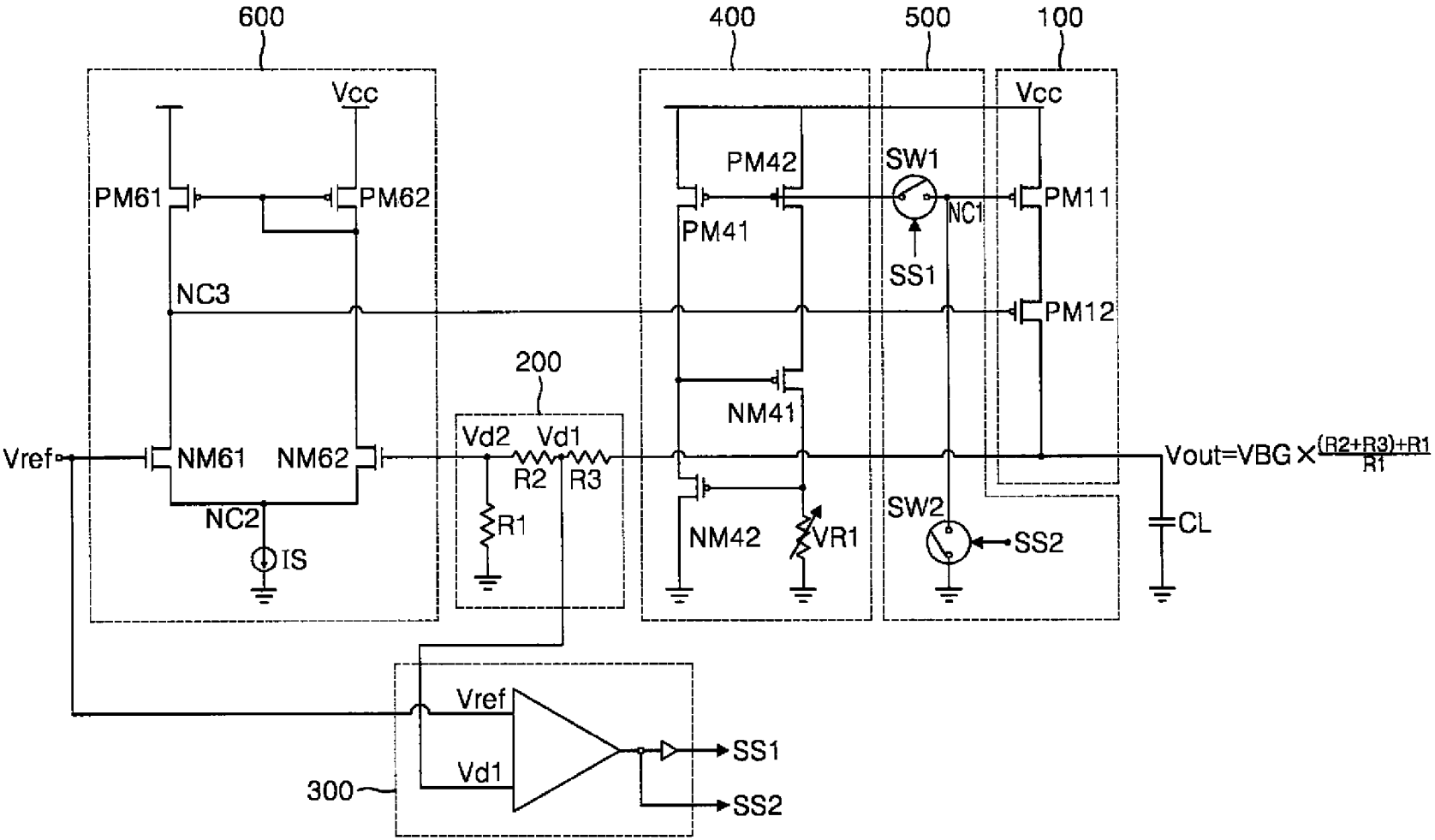
FIG. 3 is a configuration view illustrating a regulator according to an exemplary embodiment of the invention.

FIG. 3 is a configuration view illustrating a regulator according to an exemplary embodiment of the invention.

Referring to FIG. 3, a regulator according to an exemplary embodiment of the invention includes a power switch unit 100, a load capacitor CL, a voltage detection unit 200, a comparison unit 300, a current source unit 400, a current control unit 500, and an error amplification unit 600. The power switch unit 100 includes first and second power switches PM11 and PM12 that are connected in series between a power supply Vcc terminal and an output terminal OUT. The load capacitor CL is connected between the output terminal OUT and a ground, and charges a voltage by a current supplied by the power switch unit 100. The voltage detection unit 200 detects a voltage of the output terminal OUT. The comparison unit 300 compares the voltage detected by the voltage detection unit 200 and a predetermined reference voltage, and outputs first and second switching signals SS1 and SS2 having different phases according to a result of the comparison. The current source unit 400 is connected to the power supply Vcc terminal, and generates a predetermined constant current. The current control unit 500 switches a connection between a control terminal of the first power switch PM11 and the current source unit 400 according to the first switching signal SS1 of the comparison unit 300. Further, the current control unit 500 switches a connection between the control terminal of the first power switch PM11 and the ground according to the second switching signal SS2 of the comparison unit 300. The error amplification unit 600 amplifies an error voltage between the detection voltage of the voltage detection unit 200 and the predetermined reference voltage, and outputs the amplified error voltage to the second power switch PM12.

The first power switch PM11 may be composed of a first P channel MOS transistor that has a drain connected to the power supply Vcc terminal, a source connected to the second power switch PM12, and a gate corresponding to the control terminal and connected to a first connection node NC1 of the first and second current control switches SW1 and SW2.

The second power switch PM12 may be composed of a second P channel MOS transistor that has a drain connected to the source of the first power switch PM11, a source connected to the output terminal OUT, and a gate connected to an output terminal of the error amplification unit 600.

The voltage detection unit 200 includes resistor circuits R1, R2, and R3 that divide the voltage of the output terminal OUT, and detects first and second detection voltages V1 and V2 by using the resistor circuits R1, R2, and R3.

The comparison unit 300 may compare the first detection voltage Vd1 of the voltage detection unit 200 and the predetermined reference voltage Vref, and generate the first switching signal SS1 having a switching-on level and the second switching signal SS2 having a switching-off level when the first detection voltage Vd1 has a lower level than the reference voltage Vref.

Further, the comparison unit 300 may generate the first switching signal SS1 having a switching-off level and the second switching signal SS2 having a switching-on level when the level of the first detection voltage Vd1 is higher than the level of the reference voltage Vref.

The current source unit 400 may include third and fourth P channel MOS transistors PM41 and PM42, a first N channel MOS transistor NM41, a second N channel MOS transistor NM42, and a variable resistor VR1. The third and fourth P channel MOS transistors PM41 and PM42 have drains connected to the power supply Vcc terminal and gates connected to each other. The first N channel MOS transistor NM41 has a drain connected to a source of the fourth P channel MOS transistor PM42, and a gate connected to a source of the third P channel MOS transistor PM42. The second N channel MOS transistor NM42 has a drain connected to the source of the third P channel MOS transistor PM41, a gate connected to a source of the first N channel MOS transistor NM41, and a source connected to the ground. The variable resistor VR1 is connected between the gate of the second N channel MOS transistor NM42 and the ground, and varies in resistance. The variable resistor VR1 can vary the soft-start duration by controlling the constant current of the current source unit 400.

The current control unit 500 may include a first current control switch SW1 and a second current control switch SW2. The first current control SW1 is connected between the control terminal of the first power switch PM11 and the current source unit 400, and is turned on or off by the first switching signal SS1 of the comparison unit 300. The second current control switch SW2 is connected between the control terminal of the first power switch PM11 and the ground, and is turned on or off by the second switching signal SS2 of the comparison unit 300.

The error amplification unit 600 includes a fifth P channel MOS transistor PM61, a sixth P channel MOS transistor PM62, a third N channel MOS transistor NM61, a fourth N channel MOS transistor NM62, and a current source IS. The fifth P channel MOS transistor PM61 has a drain connected to the power supply Vcc terminal. The sixth P channel MOS transistor PM62 has a drain connected to the power supply Vcc terminal, and a gate and a source connected to a gate of the fifth P channel MOS transistor PM61. The third N channel MOS transistor NM61 has a gate receiving the reference voltage Vref, and a drain connected to a source of the fifth P channel MOS transistor PM61. The fourth N channel MOS transistor NM62 has a gate receiving a second detection voltage Vd2 of the voltage detection unit 200, a drain connected to the source of the sixth P channel MOS transistor PM62, and a source connected to the source of the third N channel MOS transistor NM61. The current source is connected between the ground and a second connection node NC2 between the sources of the third and fourth N channel MOS transistors NM61 and NM62.

Here, a third connection node NC3 between the source of the fifth P channel MOS transistor PM61 and the drain of the third N channel MOS transistor NM61 may be connected to the gate of the second power switch PM12.

Figure 4:
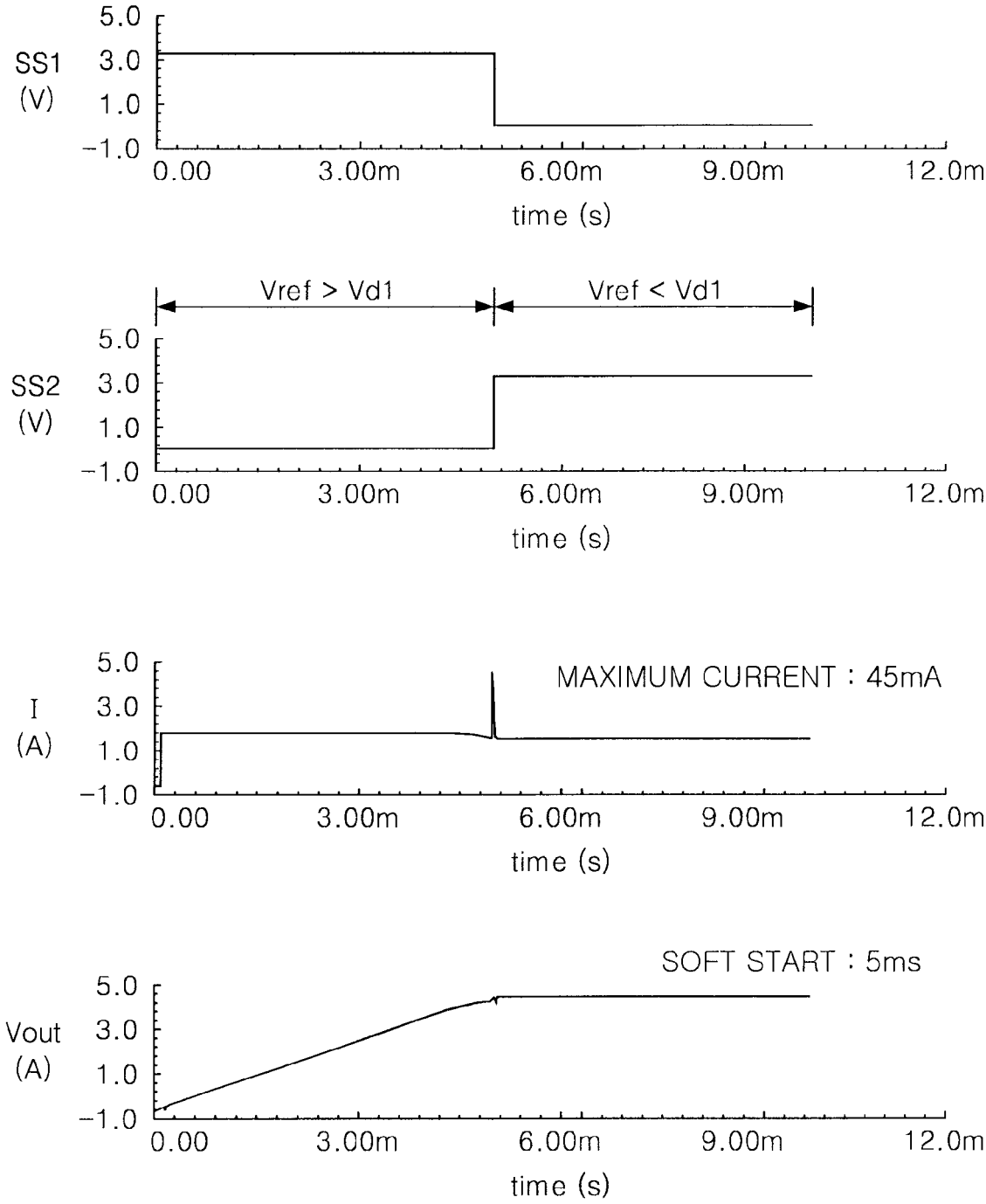
FIG. 4 is an operating timing chart of the regulator according to the embodiment of the invention.

FIG. 4 is an operating timing chart of the regulator according to the embodiment of the invention. In FIG. 4, reference character SS1 refers to the first switching signal that is output from the comparison unit 300 to the first current control switch SW1, reference character SS2 refers to the second switching signal that is output from the comparison unit 300 to the second current control switch SW2, and reference character I refers to a current flowing from the power switch unit 100 to the load capacitor CL. Reference character Vout refers to a voltage that is charged in the load capacitor CL to be output through the output terminal OUT.

Hereinafter, the operation and effect of the invention will be described in detail with reference to the accompanying drawings.

Referring to FIGS. 3 and 4, the regulator according to the embodiment of the invention will be described. In the regulator, shown in FIG. 3, the power switch unit 100 according to the embodiment of the invention includes the first and second power switches PM11 and PM12 that are connected in series between the power supply Vcc terminal and the output terminal OUT. The current I through the first and second power switches PM11 and PM12 flows through the load capacitor CL, so that the load capacitor CL is charged with the voltage.

During this process, in the regulator according to the embodiment of the invention, a constant amount of current from the current source flows for a predetermined period of time at initial power up, thereby implementing soft-starting in which a level of the voltage charged in the load capacitor increases gradually.

The voltage detection unit 200 according to the embodiment of the invention detects the voltage of the output terminal OUT, and supplies the detection voltage to the comparison unit 300 and the error amplification unit 600.

The comparison unit 300 compares the detection voltage of the voltage detection unit 200 and the predetermined reference voltage, and outputs the first and second switching signals SS1 and SS2 according to a result of the comparison.

The current source unit 400 according to the embodiment of the invention is connected to the power supply Vcc terminal, and generates a predetermined constant current.

The current control unit 500 according to the embodiment of the invention switches a connection between the control terminal of the first power switch PM11 and the current source unit 400 according to the first switching signal SS1 of the comparison unit 300. Further, the current control unit 500 switches a connection between the control terminal of the first power switch PM11 and the ground according to the second switching signal SS2 of the comparison unit 300.

During this process, the error amplification unit 600 amplifies an error voltage between the detection voltage of the voltage detection unit 200 and the reference voltage, and outputs the amplified error voltage to the second power switch PM12. Therefore, the second power switch PM12 is controlled by the error voltage of the error amplification unit 600.

Specifically, referring to FIGS. 3 and 4, the reference voltage Vref has a higher level than the detection voltage at initial power up. Therefore, as shown in FIG. 4, the comparison unit 300 according to the embodiment of the invention outputs the first switching signal SS1 having a switching-on level and the second switching signal SS2 having a switching-off level.

The voltage detection unit 200 includes the resistor circuits R1, R2, and R3 that divide the voltage of the output terminal OUT. The voltage detection unit 200 detects the first and second voltages Vd1 and Vd2 by using the resistor circuits R1, R2, and R3. In this case, since the reference voltage Vref has a higher level than the first detection voltage Vd1 of the voltage detection unit 200, the comparison unit 300 outputs the first switching signal SS1 having a switching-on level and the second switching signal SS2 having a switching-off level.

Here, since the first power switch PM11 composed of the first P channel MOS transistor is turned on, the current source unit 400 is connected to the first power switch PM11. The first power switch PM11 and the current source unit 400 form a current mirror, so that the current flowing through the first power switch PM11 becomes equal to the constant current generated by the current source unit 400.

Further, the second power switch PM12 composed of the second P channel MOS transistor is turned off. Then, the control terminal of the first power switch PM11 is separated from the ground, and connected to the current source unit 400.

After a soft-start period from the initial power up, when the first detection voltage Vd1 has a higher level than the reference voltage Vref, as shown in FIG. 4, the comparison unit 300 outputs the first switching signal SS1 having the switching-off level and the second switching signal SS2 having the switching-on level.

Here, since the first power switch PM11 is turned off, the current source unit 400 and the first power switch PM11 are separated from each other. Then, as the second power switch PM12 is turned on, the control terminal of the first power switch PM11 is connected to the ground. That is, the gate of the first P channel MOS transistor is connected to the ground.

Here, the first power switch PM11 is composed of the first P channel MOS transistor, and connected to the ground. As the first power switch PM11 is completely turned on, the largest amount of current flows through the first power switch PM11.

As shown in FIG. 3, the current source unit 400 includes the variable resistor VR1 to control the amount of the generated current.

Here, the amount of current generated in the current source unit 400 can be controlled by varying the resistance of the variable resistor VR1, and the soft-start period is determined according to the current amount. As a result, the soft-start period can be controlled by the variable resistor VR1 of the current source unit 400.

The current control unit 500 may include the first current control switch SW1 and the second current control switch SW2. The first current control switch SW1 is connected between the control terminal of the first power switch PM11 and the current source unit 400, and is turned on or off by the first switching signal SS1 of the comparison unit 300. The second current control switch SW2 is connected between the control terminal of the first power switch PM11 and the ground, and is turned on or off by the second switching signal SS2 of the comparison unit 300. The control terminal of the first power switch PM11 corresponds to the gate of the first P channel MOS transistor.

As shown in FIG. 3, the fifth P channel MOS transistor PM61 and the sixth P channel MOS transistor PM62 of the error amplification unit 600 determine an amplification gain. Further, the error amplification unit 600 amplifies the error voltage between the reference voltage Vref and the second detection voltage Vd2 of the voltage detection unit 200 by the third N channel MOS transistor NM61 and the fourth N channel MOS transistor NM62 that form a differential amplification structure. Then, the error amplification unit 600 outputs the amplified error voltage to the gate of the second power switch PM12, and controls the second power switch PM12 by using the error voltage, such that the error amplification unit 600 controls the amount of current flowing through the power switch unit 100.

As shown in FIGS. 3 and 4, at the initial power up, the current source unit is connected to the first power switch according to the first switching signal SS1 and the second switching signal SS2 of the regulator. The first power switch and the current source unit form a current mirror, so that it is controlled that a constant current flows by using the first power switch at the initial power up. The first power switch is connected to the ground after the soft-start period from the initial power up, so that it is controlled that the maximum amount of time flows.

As described above, in the related art, a battery is damaged since an excessive amount of current is drawn from the battery in order to charge the load capacitor CL when the regulator is turned on. However, according to the embodiment of the invention, the damage to the battery caused by an over voltage can be prevented by limiting a current to a current allowed to flow from the battery.

As set forth above, according to the exemplary embodiment of the invention, soft-starting is implemented by using a current source to cause a predetermined amount of current to flow through a power switch at initial power up, such that excessive power consumption can be prevented at the initial power up, and soft-starting results in noise reduction and extension of battery life.

While the present invention has been shown and described in connection with the exemplary embodiments, it will be apparent to those skilled in the art that modifications and variations can be made without departing from the spirit and scope of the invention as defined by the appended claims.

What is claimed is:

1. A regulator with soft-start using a current source, the regulator comprising:

a power switch unit including first and second power switches connected in series between a power supply terminal and an output terminal;

a load capacitor connected between the output terminal and a ground, and charging a voltage by a current through the power switch unit;

a voltage detection unit detecting a voltage of the output terminal;

a comparison unit comparing a detection voltage of the voltage detection unit and a predetermined reference voltage, and outputting first and second switching signals having different phases according to a result of the comparison;

a current source unit connected to the power terminal, and generating a predetermined constant current;

a current control unit switching a connection between a control terminal of the first power switch and the current source unit according to the first switching signal of the comparison unit, and switching a connection between the control terminal of the first power switch and the ground according to the second switching signal of the comparison unit; and an error amplification unit amplifying an error voltage between the detection voltage of the voltage detection unit and the predetermined reference voltage.

2. The regulator of claim 1, wherein the first power switch comprises a first P channel MOS transistor having a drain connected to the power supply terminal, a source connected to the second power switch, and a gate connected to a first connection node between the first and second current control switches, and the second power switch comprises a second P channel MOS transistor having a drain connected to the source of the first power switch, a source connected to the output terminal, and a gate connected to an output terminal of the error amplification unit.

3. The regulator of claim 1, wherein the voltage detection unit comprises a resistor circuit dividing the voltage of the output terminal, and detecting first and second detection voltages by the resistor circuit.

4. The regulator of claim 3, wherein the comparison unit compares the first detection voltage of the voltage detection unit and the predetermined reference voltage, and generates a first switching signal having a switching-on level and a second switching signal having a switching-off level when the first detection voltage has a lower level than the predetermined reference voltage, or generates a first switching signal having a switching-off level and a second switching signal having a switching-on level when the first detection voltage has a higher level than the reference voltage.

5. The regulator of claim 4, wherein the current source unit comprises:

third and fourth P channel MOS transistors having drains connected to the power supply terminal and gates connected to each other;

a first N channel MOS transistor having a drain connected to a source of the fourth P channel MOS transistor, and a gate connected to a source of the third P channel MOS transistor;

a second N channel MOS transistor having a drain connected to the source of the third P channel MOS transistor, a gate connected to a source of the first N channel MOS transistor, and a source connected to the ground; and a variable resistor connected to the gate of the second N channel MOS transistor and the ground, and varying in resistance.

6. The regulator of claim 5, wherein the variable resistor varies the soft-start duration by controlling the constant current of the current source unit.

7. The regulator of claim 5, wherein the current control unit comprises:

a first current control switch connected between the control terminal of the first power switch and the current source unit, and turned on or off according to the first switching signal of the comparison unit; and a second current control switch connected between the control terminal of the first power switch and the ground, and turned on or off according to the second switching signal of the comparison unit.

8. The regulator of claim 5, wherein the error amplification unit comprises:

a fifth P channel MOS transistor having a drain connected to the power supply terminal;

a sixth P channel MOS transistor having a drain connected to the power supply terminal, and a gate and a source connected to a gate of the fifth P channel MOS transistor, a third N channel MOS transistor having a gate receiving the reference voltage, and a drain connected to a source of the fifth P channel MOS transistor;

a fourth N channel MOS transistor having a gate receiving the second detection voltage of the voltage detection unit, a drain connected to the source of the sixth P channel MOS transistor, and a source connected to a source of the third N channel MOS transistor; and a current source connected between a second connection node between the sources of the third and fourth MOS transistors and the ground, wherein a third connection node between the source of the fifth P channel MOS transistor and the drain of the third N channel MOS transistor is connected to the gate of the second power switch.

* * * * *